US006368145B1

(12) United States Patent
Schwarz et al.

(10) Patent No.: US 6,368,145 B1
(45) Date of Patent: Apr. 9, 2002

(54) PLUG

(75) Inventors: Gerhard Schwarz, Allemuehl; Reiner Naumann, Mannheim; Helmut Deschner, Eberbach; Theo Grimm, Mudau; Gerd Hofmann, Eberbach; Dieter Sauer, Heddesbach, all of (DE)

(73) Assignee: Ceag Sicherheitstechnik GmbH, Soest (DE)

( * ) Notice: Subject to any disclaimer, the term of this patent is extended or adjusted under 35 U.S.C. 154(b) by 0 days.

(21) Appl. No.: 09/520,028

(22) Filed: Mar. 6, 2000

(30) Foreign Application Priority Data

Mar. 5, 1999 (DE) ..... 299 04 053 U

(51) Int. Cl.[7] ..... H01R 13/58
(52) U.S. Cl. ..... 439/469; 439/459
(58) Field of Search ..... 439/469, 459, 439/460, 461, 462, 465, 578

(56) References Cited

U.S. PATENT DOCUMENTS 4,749,369 A 6/1988 Wang ..... 439/459
4,931,023 A 6/1990 Browne ..... 439/459
5,167,527 A 12/1992 Clark ..... 439/469
5,830,009 A * 11/1998 Tettinger ..... 439/578
6,077,122 A * 6/2000 Elkhatib et al. ..... 439/608
6,149,455 A * 11/2000 Levi ..... 439/462

FOREIGN PATENT DOCUMENTS

DE 33 29 388 4/1987
DE 41 01 175 8/1991

OTHER PUBLICATIONS

German Searh Report, Oct. 21, 1999.

* cited by examiner

*Primary Examiner*—P. Austin Bradley
*Assistant Examiner*—Alexander Gilman
(74) *Attorney, Agent, or Firm*—Fish & Richardson P.C.

(57) ABSTRACT

A plug includes at least one plug body having an axial bore, with a cable being insertable into the plug body at the one end of the plug body, and which can be connected to electric contact elements arranged at the second end. The first end has an associated strain relief mechanism including at least two clamping elements adjustably supported for clamping the cable. The plug body also has at least two sliding guides open to the outside in the direction toward the axial bore, in which the clamping elements are movably guided.

43 Claims, 3 Drawing Sheets

PLUG

TECHNICAL FIELD

This invention relates generally to a plug including a plug body having an axial bore for insertion of a cable at one end of the plug body for connection to electric contact elements arranged at the other end of the plug body, and more particularly to a plug including a strain relief mechanism located at the first end of the plug body and having at least two clamping elements adjustably supported for clamping the cable.

BACKGROUND

In a prior plug, a strain relief mechanism is formed by three annular clamping segments that are joined by screws. When the screws are tightened, an area through which the cable passes is reduced. The annular segments are movably supported on an end of the plug body, and are covered by a cover screwed onto the plug body when the plug is assembled. An o-ring is arranged between the cover and the annular segments. When the cover is screwed on to the plug body, the o-ring is compressed and pressed in the direction of the cable to seal the cable. The cable extends through an axial bore in the plug body up to the contact elements to which it is connected.

The strain relief mechanism can be fitted to cables of different diameters in a simple manner and safely prevents a direct tensile load on the connection between the cable and the electric contact elements.

SUMMARY

In one general aspect, the invention features a plug including a plug body with an axial bore. A cable may be inserted into the plug body at the first end of the plug body and may be connected to contact elements arranged at the second end. A strain relief mechanism positioned at the first end of the plug body has at least two clamping elements adjustably supported for clamping the cable. The plug body includes at least two sliding guides open towards the axial bore and towards the outside, with the clamping elements being movably guided in the sliding guides.

Use of the sliding guides provides a plug that tends to be even simpler and less expensive than known plugs, while also providing improved accessibility to the strain relief mechanism. Through use of the sliding guides, the clamping elements are directly supported in the plug body and not at one of its ends. Furthermore, since the clamping elements are accessible through the sliding guides, which are open to the outside, they can be adjusted for clamping the cable. The sliding guides can be formed in a simple and inexpensive manner as radially inwardly extending openings provided in a wall of the plug body. Side walls of these openings may serve for guiding the clamping elements. The sliding guides permit a highly efficient strain relief mechanism that provides safe clamping of cables having different diameters.

The plug body includes at least one plug inset provided with the contact elements, a plug cap, and a plug sleeve arranged between the plug inset and the plug cap. At least the plug cap and the plug sleeve can be rotated with respect to one another. To realize simple accessibility to the strain relief mechanism, the sliding guides can be formed directly in the plug cap.

To secure the cable against tension directly after insertion, the sliding guides may be arranged adjacent to an insertion opening of the first end of the plug cap. To permit secure coupling to cables having different diameters, the sliding guides may be in the form of longitudinal holes extending transversely to the axial bore beyond the insertion opening, and the clamping elements may have shapes complementary to the longitudinal holes. In this manner, the clamping elements are guided on all sides in the longitudinal holes.

In one implementation, each clamping element has substantially planar side faces extending transversely to the axial bores and end curves connecting the ends of the side faces. This leads to an approximately elongate, oval cross-section for a clamping element of this kind.

Each clamping element may include a protruding edge extending transversely to the cable on a lower side of the clamping element pointing to the cable. When the clamping element approaches a cable, this protruding edge is pressed into the cable's insulation. The cable may be held on both sides by the use of two opposite clamping elements to secure against tension on the contact elements. To enlarge the surface contact between the clamping element and the cable or the cable's insulation, the lower side of the clamping element facing the axial bore may have a concave recess for at least partially accommodating the cable. Since the cables usually have a circular cross section, the recess can also be substantially circular.

The recess may have at least one clamping projection protruding in the direction of the cable on the clamping side facing the cable. When the clamping elements are tightened, this clamping projection is pressed partially in to the insulation of the cable. In one implementation, the clamping projection can be formed as a clamping rail extending in the axial direction. The clamping rail serves both to support the cable and to reduce rotation of the cable.

To prevent a clamping element from falling out of a sliding guide when releasing the clamping elements from one another, at least one clamping element may have an abutment projecting from the clamping side in the axial direction over a side face to the outside. The abutment contacts the insertion opening, such that the clamping element only moves radially to the outside until the abutment contacts the inner rim of the insertion opening. Each of the clamping elements may have such an abutment. The abutments may be arranged such that the insertion opening is fully open when the abutments contact the inner rim of the insertion opening. In some implementations, at least one of the clamping elements may be removable from the clamping element's sliding guide.

To improve movement of the clamping elements in the sliding guides, a guiding projection may project toward the outside from at least one side face of a clamping element. The guiding projection movably engages a corresponding guide groove which extends in the displacement direction of the clamping element.

The appearance of the plug may be improved and a possible risk of injury may be avoided by forming an outer side of the clamping element opposite to the lower side to have a radius of curvature substantially equal to the outer side of the plug cap. In this way, the clamping elements do not protrude with sharp edges, and, instead, are arranged in the sliding guides, depending on the diameter of the cable to be secured, in a flush or countersunk manner.

Although the cable is held partially secure against rotation, as stated above, a rotation of the cable relative to the electric contact elements may, however, still take place if, for example, the plug cap is twisted relative to the plug body. This can be prevented through use of a rotation prevention projection that extends from at least one clamping element substantially in the axial direction. The projection engages in different rotational positions of the plug cap relative to the plug sleeve through interaction with engagement recesses formed in the plug sleeve. By the mutual engagement of the rotation preventing projection and the engagement recess, a further rotation of the plug cap relative to the plug sleeve or an accidental release of both members is prevented.

In one implementation, the engagement recess is formed between walls extending radially outward relative to the axial bore. The walls restrict the rotation of the plug cap relative to the plug sleeve in that the rotation prevention projection abuts one of the walls in the direction of rotation.

To enable multiple relative positions between the plug cap and the plug sleeve, and at the same time to maintain the protection against rotation, multiple engagement recesses can be arranged equidistantly around the circumference of the plug sleeve.

To easily connect the plug sleeve and the plug cap, the plug sleeve may include an end section at least partially provided with an external thread, with the plug cap having an internal thread section being screwable onto the end section. To form the rotation prevention projections in a simple manner and with a short length, the engagement recesses of the plug sleeve can be arranged directly adjoining the end section.

To cover the recesses when screwing the plug cap onto the plug sleeve, the plug cap may have an annular flange at least accommodating the recesses and following the internal thread section.

To permit simple access to the rotation prevention projection from the outside, the insertion opening may be arranged in the annular flange through which the rotation prevention projection can be engaged with a recess. For releasing the plug cap, the rotation prevention projection can be disengaged from the recess through the insertion opening from the outside so that a subsequent rotation of the plug cap relative to the plug sleeve can be performed. Thus, both the rotation prevention projection and the clamping elements can be adjusted from the outside for holding or releasing the cable.

In some implementations, when the walls restricting the engagement recesses extend radially beyond the external thread of the end section, the annular flange is formed with an external diameter greater than an external diameter of the internal thread section.

The rotation prevention projection may be implemented in different ways. For example, a rotation prevention projection that is simple to manufacture projects in an arm-like manner from a clamping element and has a free end that engages through the insertion opening into a recess with clamping elements attached to one another. A rotation prevention projection or rotation prevention arm may be formed at each clamping element.

A rotation prevention arm may extend in a first arm section adjacent to the clamping element transversely to the outside relative to the plug cap and in a second arm section connected thereto transversely downward in the direction of the axial bore, such that an obtuse angle is formed between the two arm sections. The second arm section projects through the insertion opening into the interior of the plug cap and engages the engagement recess.

The internal thread section on an outer side may have a ramp recess substantially extending in the direction toward the first arm section. The first arm section with clamping elements attached to one another can be inserted at least partially into this ramp recess, such that the rotation prevention arm projects less over the outer side of the plug cap toward the outside.

A simple possibility for the mutual adjustability of the clamping elements and for fixing them to each other is when the clamping elements have bores at their lateral ends for accommodating attachment and adjustment screws. The screws may be partially screwed into the clamping element with the rotation prevention arm, and they may be inserted into the corresponding sliding guide. The other clamping element in its sliding guide is secured against falling out by the abutment noted above. By further turning the screws, the two clamping elements can be fixed to one another and can be moved toward one another for clamping the cable passed between them.

To arrange the screws in a manner sunk in the clamping elements with clamping elements fixed to one another, each bore may have (at least in the clamping element from where the screws are inserted) an accommodation bore section open toward the outside and having an enlarged diameter for accommodating a screw head.

To facilitate screwing the plug cap on to the plug sleeve and to facilitate a mutual release, the internal thread section can be formed at least adjacent to the annular flange as a screw aid with a hexagonal outer contour. A wrench or the like can then be used as an aid for twisting the screw cap.

To restrict a movement of each clamping element within the sliding guide in the direction toward the other clamping element, abutment projections located approximately centrally with respect to the insertion opening can radially project inwardly within the sliding guide. Ends of the lower sides of the respective clamping elements can be abutted against the abutment projections.

To ensure that the clamping elements can be positioned close enough to one another to clamp a cable with a small diameter, an end recess can be arranged at the end of the lower side to at least partially receive the accommodation projection.

When using the plug in environments in which there is a risk of explosion, a sealing element for sealing the electric connection between the cable and the electric contact elements within the plug must be provided. Such a sealing element is described, for example, in U.S. Pat. No. 5,167,527, which is incorporated by reference. The sealing element is held between two annular elements and is compressed and sealed against the cable when the annular elements are moved toward one another by screwing the cover onto the plug body.

A sealing seat for accommodating a sealing element can be connected at the free end of the end section of the plug sleeve at the external thread. In this manner, the sealing seat is not a separate component, but, instead, is part of the plug sleeve. The sealing seat may be formed by an opening rim of the axial bore in the end section at which the substantially annular sealing element abuts with an abutment end. When screwing on the plug cap, the sealing element may be pressed against the outer side of the cable for sealing.

To hold the sealing element in a more secure manner, in particular when assembling or disassembling the plug, an annular chamber for accommodating the sealing element may project from the opening rim in the direction toward the plug cap. The annular chamber has a varying diameter, and the sealing element is held in the annular chamber and secured against accidentally falling out.

A taper may be formed within the plug cap to enable simple variation of the diameter of the annular chamber and thereby a pressing of the sealing element to an outer side of the cable for sealing purposes. When the plug cap is screwed on to the plug sleeve, the taper contacts the annular chamber for the purpose of reducing its diameter. The taper may be implemented as a section that gradually reduces in diameter within the axial bore of the plug cap. When screwing the plug cap on to the plug sleeve, the annular chamber in the corresponding section is gradually compressed by this internal diameter reduction and the sealing element is pressed against the cable.

The annular chamber may have a wall of resiliently deflectable lamellae, which project from the opening rim substantially in the axial direction. The free ends of the lamellae then contact the section of reducing internal diameter when screwing on the plug cap and are pressed radially inwards.

To hold the sealing element and at the same time to facilitate a screwing on of the plug cap, the lamellae may obliquely extend from the opening rim to the inside. It is also possible that the lamellae may have an inclination only on their radially outward side at least at the free end.

To further improve the sealing between the plug sleeve and the cable provided by the sealing element, the opening rim may have a sealing lip protruding in the direction toward the abutment end of the sealing element. For example, the sealing lip may be formed as a V-notch encompassing the axial bore within the plug sleeve. The sealing element may have a sealing rim engaging into a recess between the V-notch or sealing lip and lamellae, respectively.

To enable a simple, inexpensive adaptation to different diameters of cables without completely exchanging the sealing element, the sealing element may at least be formed of two parts, an outer sealing ring and an inner sealing ring. The outer sealing ring can be used independent of the cable used while the inner sealing ring is exchangeable for adaptation to different diameters. To this end, the inner sealing ring may have an annularly extending sealing flange as a sealing rim, which, as stated above, engages into the recess between the V-notch or sealing lip and lamellae, respectively. The sealing flange may project radially outwardly to such an extent that the outer sealing ring can be slipped on to the inner sealing ring until the outer sealing ring abuts the sealing flange at an end of the inner sealing ring.

To reduce costs, the outer sealing ring and the inner sealing ring may be made of different materials. For example, the outer sealing ring may be made of a less expensive material which only takes over a minor part of the sealing function, while the inner sealing ring with the rotating sealing flange serves for the actual sealing and may be made of a more expensive material which safely seals the cable with respect to the plug body.

The rotation prevention projection and the rotation prevention arm may be resiliently deflectable so that, when the clamping elements are not released from one another or only released from another to a small extent, a relative rotation between the plug cap and the plug sleeve is possible by deflecting the rotation prevention arm to the outside.

The strain relief and the rotation prevention can be established substantially independent of one another. Independent of the position of the insertion opening with respect to the engagement recess, the strain relief can be established through the strain relief mechanism. The rotation prevention is also established after establishment of the strain relief by engagement of the free arm end by the insertion opening into an engagement recess.

The plug with its various members may be made, for example, from a plastic material, such as glass-fiber reinforced polyester or polyamide.

Other features and advantages will be apparent from the description and drawings, and from the claims.

DESCRIPTION OF DRAWINGS

Like reference symbols in the various drawings indicate like elements.

DETAILED DESCRIPTION

Figure 1:
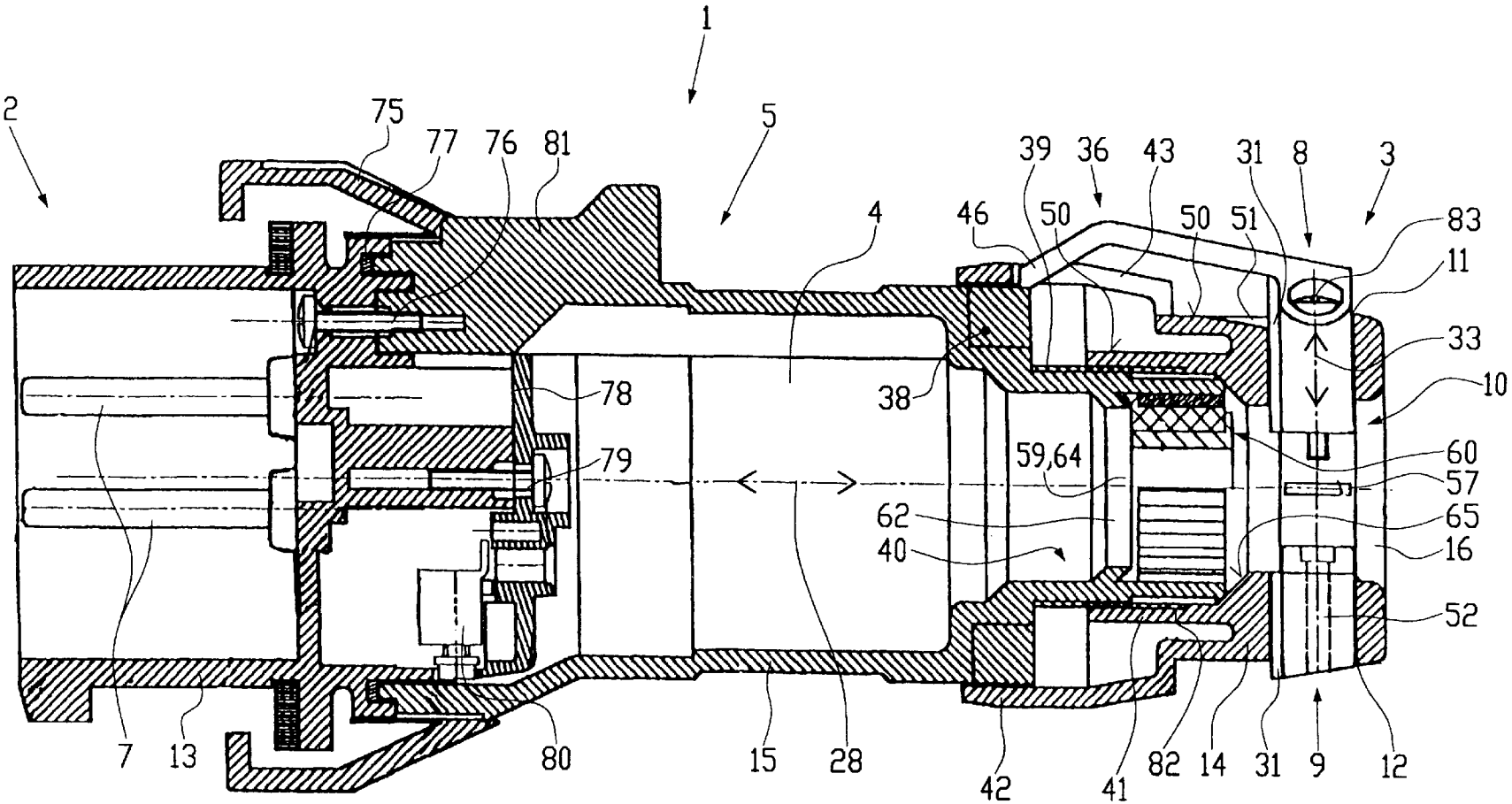
FIG. 1 shows a longitudinal section through a plug.

FIG. 1 shows a longitudinal section through a plug 1 that includes at its left end 2 in FIG. 1 a plug inset 13 in which electric contact elements 7 are arranged. These contact elements are plugged in the usual manner into a socket as an insertion means for establishing an electrical contact. The plug 1 also includes a plug sleeve 15 into which the plug inset 13 is at least partially inserted. At the left end of the plug sleeve 15, this plug sleeve may have a rotatable ring 75, which as a bayonet catch serves for attaching the plug 1 to the socket. The plug cap 14 is connected to the plug sleeve 15, and includes a further, right end 3 of the plug body 5 formed of plug inset 13, plug sleeve 15 and plug cap 14.

Figure 4:
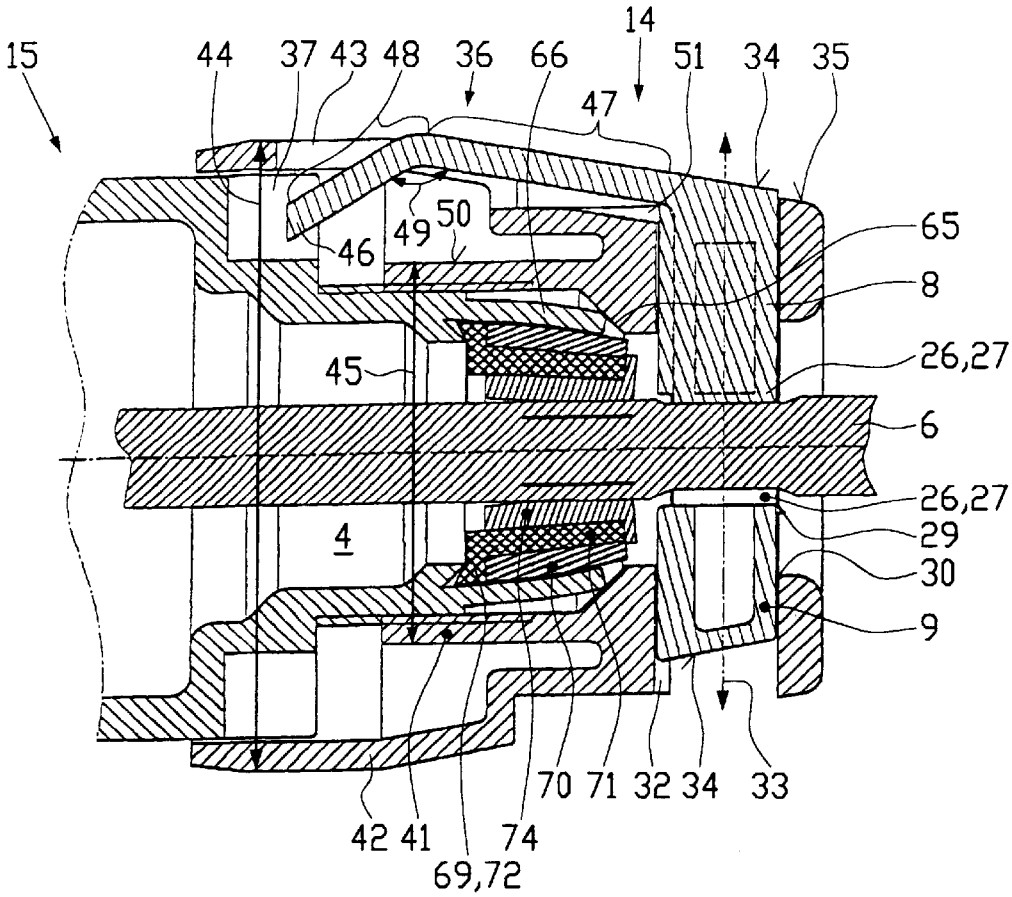
FIG. 4 shows a view corresponding to FIG. 2 with the cable inserted.

The plug inset 13 can be screwed to the plug sleeve by screws 76, one of which is shown. A sealing ring 77 is arranged between the plug inset and the plug sleeve. An end of the plug inset 13 is inserted into the plug sleeve 15 and can be locked by an end plate 78 by means of a screw 79. The end plate 78 includes through bores for inserting electric conductors, which can be connected to the electric contact elements 7 by means of tension bracket screws or truss screws 80. The electric conductors are part of an electric cable 6, as shown in FIG. 4.

An abutment 81 may project radially outwardly from the plug sleeve 15. The abutment restricts the rotation of the bayonet catch 75 relative to the plug sleeve.

An axial bore 4 is formed in the plug sleeve 15 and in the plug cap 14, with the cable 6 (FIG. 4) being insertable into the plug through the axial bore and being passable up to the plug inset 13. The axial bore 4 substantially extends in the axial direction 28. The plug sleeve 15 comprises an end section 40 which is insertable into the interior of the plug cap 14. The end section 40 is at least partially provided with an external thread 39 onto which the plug cap 14 having a corresponding internal thread 82 can be screwed. The internal thread is formed on an inner side of the internal thread section 41 of the plug cap 14. A screwing-on taper 65 extending radially inwardly and in the direction of the first end 3 of the plug 1 adjoins the internal thread section 41. When screwing the plug cap 14 on to the plug sleeve 15, the screwing-on taper engages a free end of the end section 14. This free end is formed by an annular chamber 64 as a sealing seat 59 in which a sealing element 60 is accommodated. The annular chamber 64 is formed by a plurality of lamellae 66 (FIG. 3) arranged along a circumferential direction of the end section 40.

Figure 2:
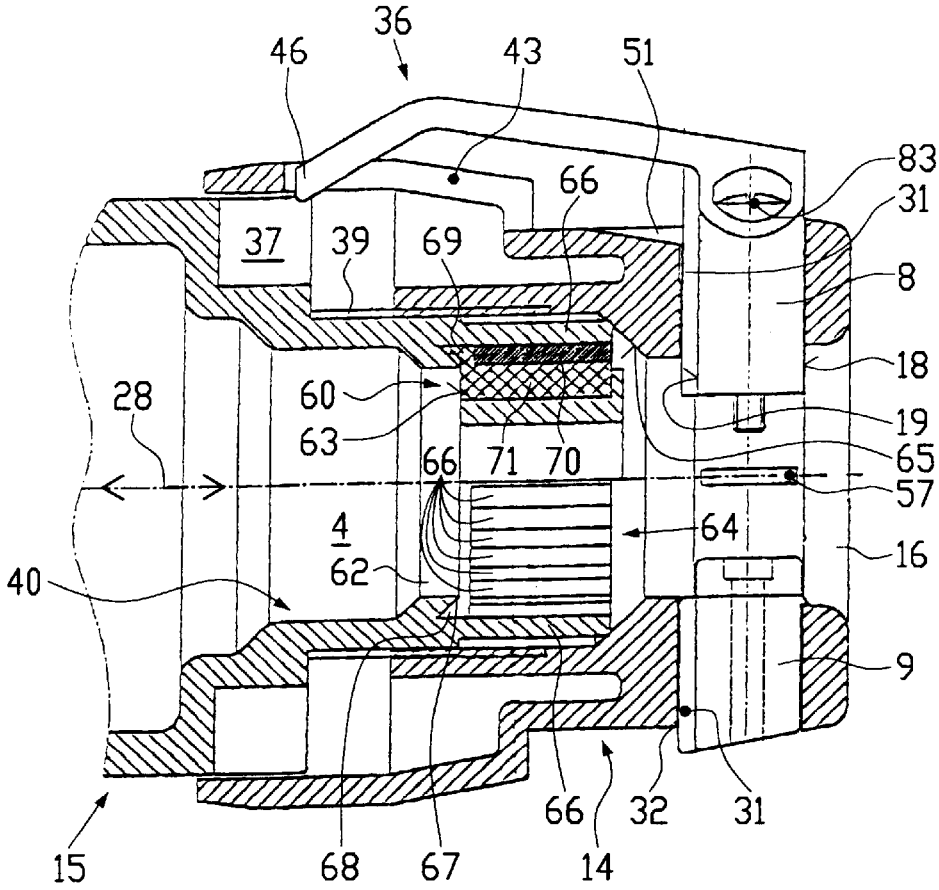
FIG. 2 shows an enlarged partial section of the plug of FIG. 1.

Furthermore, the sealing seat 59 comprises an opening rim 62 with which a sealing rim 69 (FIG. 4) of the sealing element 16 is in contact. The opening rim includes a sealing lip 67 offset radially inwards with respect to the lamellae (FIG. 2).

In FIG. 1, the plug cap 14 is screwed on to the plug sleeve 15 by the external thread 39 and the internal thread 82 to such an extent that the free ends of the lamellae 66 contact the screwing-on taper 75.

Sliding guides 11 and 12 are arranged in opposite fashion between the internal thread section 41 and the insertion opening 16 at the first end 3 of the plug cap 14. The sliding guides 11 and 12 are open in the direction toward the axial bore 4 and toward the outer side 50 of the plug cap 14. A clamping element 8 or 9, respectively, is inserted into the sliding guides, and this clamping element is movably guided therein. The sliding guides 11, 12 have in a plane perpendicular to the drawing plane of FIG. 1 the shape of a longitudinal hole and project beyond both sides of the insertion opening 16.

The two clamping elements 8, 9 arranged in the sliding guides 11, 12 form strain relief mechanism 10 (FIG. 4) in that they clamp the cable 6 and prevent a tensile strain of the connection between the cable 6 and the electric contact elements 7 in the plug inset 13.

The clamping element 9 comprises bores 52 at its two lateral ends. Screws 83 of the other clamping element 8 can be screwed into the bores for mutual attachment and for clamping the cable 6 (FIG. 4). An arm-shaped rotation prevention projection 36 projects from the upper clamping element 8 in the direction toward the plug sleeve 15. This projection engages with its free arm end 46 into an insertion opening 43, which is formed in an annular flange 42 projecting from the plug cap 14 in the direction towards the plug sleeve 15. The annular flange 42 grips over the plug sleeve 15 and is arranged radially outwardly spaced apart from the internal thread section 41 of the plug cap 14.

In the view according to FIG. 1, the free arm end 46 rests on a wall 38 from the radial outside (see also FIGS. 3 and 4), with the wall being arranged at both sides of an engagement recess 37 at the outer circumference of the plug sleeve 15.

The clamping elements 8, 9 are moveable in the clamping direction 33 towards one another or apart from one another. The sliding guides 11, 12 comprise inwardly projecting rest abutments 57 between the clamping elements 8 and 9 and approximately centrally with respect to the insertion opening 16. Lateral ends of the clamping elements 8, 9 can be contacted with the rest abutments.

On an outer side 50 of the plug cap 15 a ramp recess 51 is formed into which the rotation preventing arm 36 can be deposited in the most inserted position of the clamping element 8. The inclination of the ramp recess 51 basically corresponds to the inclination of the section of the rotation preventing arm directly adjacent to the clamping element 8 (see also FIG. 4).

In FIG. 2, the plug cap 14 of FIG. 1 is shown in an enlarged scale. As shown, an engagement recess 37 between two adjacent walls 38 can be seen into which the free arm end 46 of the rotation preventing arm 36 partially engages. The end section 40 of the plug sleeve 15 is inserted within the plug cap 14. This end section ends with an annular flange 64 which is encompassed by a plurality of lamellae 66. The lamellae 66 extend in parallel to the axial direction 28 in the direction of the insertion opening 16. In another embodiment, the lamellae 66 may extend somewhat inclined towards each other so that the sealing element 60 is safely held in the annular chamber 64.

The sealing element 60 is formed of an inner sealing ring 71 and a outer sealing ring 70. The outer sealing ring is plugged onto the inner sealing ring and abuts the sealing rim 69 projecting radially outwardly from the abutment end 63 of the inner sealing ring 71. The sealing rim 69 comprises along its circumference a sealing nose engaging into a recess 68 formed between the sealing lip 67 and the lamellae 66, also see FIG. 4. Moreover, a sealing inset 74 can be inserted into the inner sealing ring 71, said sealing inset having a radially projecting rim opposite to the sealing rim 69.

Figure 6:
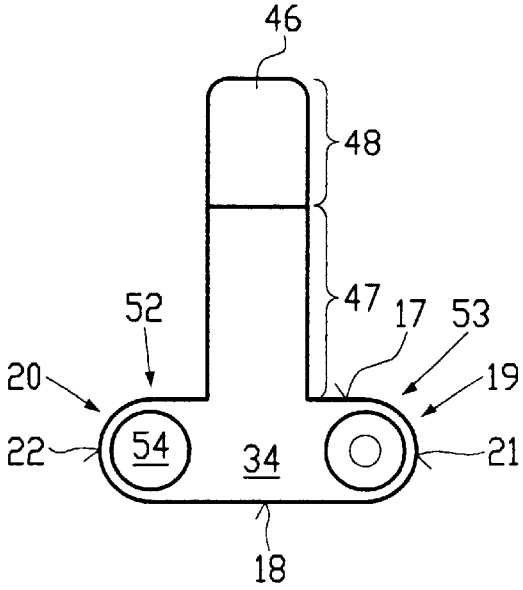
FIG. 6 shows a top view onto the clamping element according to FIG. 5.

Regarding the clamping elements 8 and 9, it must still be remarked that these clamping elements comprise planar lateral surfaces 18, 19 extending normal to the drawing plane of FIG. 2, the ends of which being joined by means of end curves 21, 22, see FIG. 6. Rail-like guide projections 31 project from the inner lateral surfaces 19, which engage into corresponding grooves 32 of the sliding guides 11, 12, also see FIG. 1 and which also extend along the displacement direction 33.

Figure 3:
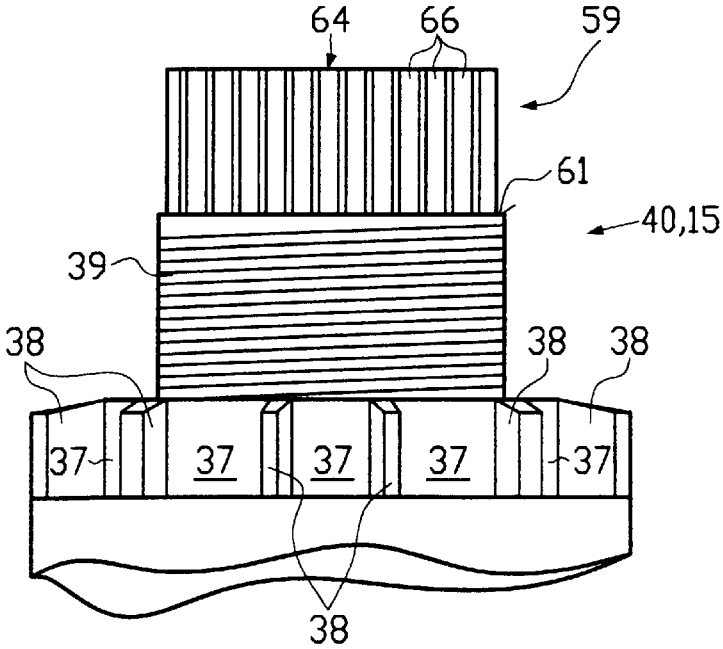
FIG. 3 shows a top view on to a partial section according to FIG. 1 without the plug cap.

FIG. 3 shows a top view in particular onto the end section 40 of the plug sleeve 15. In this end section 40 the walls 38 are arranged in a star-like manner which project to the radial outside, also see FIG. 1. The engagement recesses 37 are formed between the walls 38. The external thread 39 with reduced diameter adjoins to the walls, the internal thread section 41 of the plug cap 14, see in particular FIGS. 1, 2 and 4, being screwable onto the external thread. The lamellae 66 adjoin to the external thread 39, said lamellae forming the annular chamber 64 or delimiting the annular chamber. These lamellae 66 and the opening rim 62 encompassed by the disks, see FIG. 2, form the sealing seat 59 for accommodating the sealing element 60.

The lamellae 66 are resiliently deflectable, see e.g. FIGS. 2 and 4 so that they are deflectable towards the inside in the direction of the axial bore 4, in case of a contact with the screwing-on taper 65, see in particular FIG. 4.

FIG. 4 shows a view similar to FIG. 2, wherein in this case the plug cap 14 is further screwed onto the plug sleeve 15. Moreover, the cable 6 is clamped between the clamping elements 8, 9.

Figure 5:
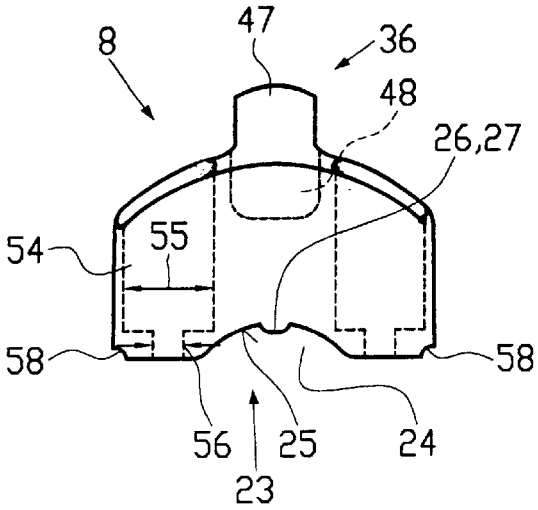
FIG. 5 shows a side elevation view of a clamping element.

On its lower side, the clamping element 8 comprises a partially-circular recess 24, also see FIG. 5, which is opposed by a corresponding concave recess in the clamping element 9. A clamping rail 27 as a clamping projection 26 is arranged centrally in the recess 24 at the clamping element 8. This clamping rail extends in the axial direction 28. On the opposite clamping element 9 two spaced clamping rails 27 are formed which are arranged on both sides offset with respect to the clamping rail 27 of the clamping element 8.

In the view according to FIG. 4, by contact with the free ends of the lamellae 66, the screwing-on taper 65 presses these lamellae to the inside towards one another so that the sealing element 60 is also pressed to the inside in the direction of the cable 6. Thereby the sealing element 60, also see FIGS. 1 and 2 also engages an insulation of the cable 6 and hermetically seals the space formed between the end plate 78, see FIG. 1, and the seal of sealing element 60 and insulation of the cable 6, against the surroundings.

The rotation prevention arm 36 is shown in relaxed position in which it engages into one of the engagement recesses 37 with its free arm end 46. The rotation prevention arm 36 comprises a first arm section 47 and a second arm section 48, between which section an obtuse angle 49 is formed. The first arm section 47 extends from the clamping element 8 transversely to the outside in the direction towards the plug sleeve 15. The second arm section 43 extends transversely to the inside. The rotation prevention arm 36 is resiliently deflectable.

To accommodate the end section 40 with the radially projecting walls 38 the annular flange 42 comprises in this portion a diameter 44 that is greater than a diameter 45 of the internal thread section 41.

The outer sides 34 of the clamping elements 8, 9 extend in accordance with the outer side 50 of the plug cap 14 transversely towards the outside in the direction towards the plug sleeve 15 and moreover comprise a radius of curvature corresponding to this outer side with respect to the axial direction 28. In the clamping position according to FIG. 4, the screws 83 arranged in the clamping element 8 are screwed into the corresponding bores of the clamping element 9 to sufficiently move the two clamping elements towards one another and to clamp the cable 6 between the clamping sides 25, see FIG. 5.

FIG. 5 shows a side view in the axial direction 28 of the clamping element 8. In particular, the partially circular recess 24 on the lower side 23 of the clamping element 8 can be seen. The clamping rail 27 is arranged as a clamping projection 26 centrally in this concave recess 24. It must be noted again that the recess 24 of the clamping element 9 is formed correspondingly, wherein in the embodiment shown, two clamping rails 27 are spaced and laterally offset with respect to the clamping rail of FIG. 5.

The bores 52, 53 are arranged laterally to the rotation prevention arm 36 in the clamping element 8, also see the top view onto the clamping element 8 according to FIG. 6. These bores comprise accommodation bore sections 54 having diameter 55 open towards the upper side of the clamping element 8. This diameter is greater than a diameter 56 of the remaining bores 52, 53. The diameter 55 of the accommodation bore section 54 is formed sufficiently large for receiving a screw head, see in particular FIGS. 1 and 2 of the screws 83.

FIG. 6 shows a top view onto the clamping element according to FIG. 5. The recess 24 forms the clamping side 25 on the lower side 23 of the clamping element 8 that at least partially accommodates an insulation of the cable 6.

The oval elongate shape with the two bores 52 and 53 at its ends corresponds or is complementary to the longitudinal shape of the sliding guides 11, 12, so that the clamping element 8 is formed on all sides in the sliding guides 11, 12. The side faces 17, 18 and the end curves 21, 22 connecting their ends 19, 20 contact corresponding surfaces or sides of the sliding guides 11, 12.

It must be pointed out that on the lower side 53 of the clamping elements 8, 9 at their lateral ends, step-like end recesses 58 are arranged, see FIG. 5, which in case of maximally approached clamping elements 8, 9 abut on both sides of the abutment projections 57, see FIGS. 1 and 2. Furthermore, an abutment 29 can project from at least one side face 17, 18 in particular of the clamping element 9, see FIG. 4, which can be abutted with the inner rim 30 of the insertion opening 16. By this abutment 29 or the contact thereof with the inner rim 30 the clamping element 9 is held in the sliding guide 12, wherein in the embodiment shown the clamping element does not comprise such an abutment and can be fully pulled out of the sliding guide 11 towards the top.

A number of embodiments of the invention have been described. Nevertheless, it will be understood that various modifications may be made without departing from the spirit and scope of the invention. Accordingly, other embodiments are within the scope of the following claims.

What is claimed is:

1. A plug comprising:

a plug body having an axial bore and at least two sliding guides open to the axial bore, with a cable being insertable into the plug body at a first end of the plug body and through the axial bore, and being connectable to contact elements arranged at a second end of the plug body; and a strain relief mechanism positioned at the first end of the plug body, having at least two clamping elements adjustably supported for clamping the cable, wherein the clamping elements are displaceably guided in the sliding guides and are adjustable from outside the plug body when the plug is assembled;

wherein the each sliding guide is in the shape of a longitudinal hole and extends transversely to the axial bore beyond the insertion opening, and each clamping element has a shape substantially complementary to a corresponding longitudinal hole.

2. A plug as claimed in claim 1, wherein the clamping elements comprise on their lateral ends bores for accommodating screws for attaching the clamping elements.

3. A plug as claimed in claim 2, wherein the bore of at least one clamping element comprises an accommodation bore section open toward the outside and having an enlarged diameter for accommodating a screw head.

4. A plug as claimed in claim 1, wherein, each clamping element includes substantially planar side faces extending transversely to the axial bore and end curves connecting the ends of said side faces.

5. A plug as claimed in claim 4, wherein at least one clamping element has an abutment projecting toward the outside from the clamping side in the axial direction beyond the side face, wherein the abutment can be brought into contact with an inner rim of the insertion opening.

6. A plug as claimed in claim 4, wherein, a guide projection projects to the outside from at least one side face, said guide projection displaceably engaging into a corresponding guide groove which extends in the displacement direction of the clamping element.

7. A plug as claimed in claim 4, wherein an outer side of the clamping element opposite to the lower side has substantially the same radius of curvature as the outer side of the plug cap.

8. A plug as claimed in claim 4, wherein a lower side of each clamping element pointing toward the axial bore has a concave recess for at least partially accommodating the cable.

9. A plug as claimed in claim 8, wherein the recess is partially circular.

10. A plug as claimed in claim 8, wherein the recess comprises at least one clamping projection projecting in the direction of the cable on a side pointing toward the cable.

11. A plug as claimed in claim 10, wherein the clamping projection is formed as a clamping rail extending in the axial direction.

12. A plug as claimed in claim 1, wherein the plug body comprises at least one plug inset provided with the contact elements, a plug cap, and a plug sleeve arranged between the plug inset and the plug cap, and the sliding guides are formed in the plug cap.

13. A plug as claimed in claim 12, wherein the sliding guides are arranged adjacent to an insertion opening at the first end of the plug cap.

14. A plug as claimed in claim 13, wherein abutment projections within the slide guides project radially inward approximately centrally to the insertion opening.

15. A plug as claimed in claim 14 and further comprising an end recess arranged at the end of a lower side of the at least two clamping elements for at least partially accommodating the abutment protection.

16. A plug comprising:

a plug inset provided with contact elements;

a plug cap having an axial bore and at least two sliding guides open to the axial bore formed in the plug cap, with a cable being insertable into the plug cap, through the axial bore, and being connectable to the contact elements;

a plug sleeve arranged between the plug inset and the plug cap;

a strain relief mechanism positioned at the plug cap, having at least two clamping elements adjustably supported for clamping the cable, wherein the clamping elements are displaceably guided in the sliding guides; and a rotation prevention projection projecting substantially in the axial direction from at least one clamping element, said rotation prevention projection engaging in different rotary positions of the plug cap relative to the plug sleeve into engagement recesses formed in the plug sleeve.

17. A plug as claimed in claim 16, wherein, independent of the position of the insertion opening in the annular flange relative to the engagement recess in the plug sleeve, strain relief by the strain relief mechanism can be established.

18. A plug as claimed in claim 17, wherein rotation can be prevented by engagement of a rotation prevention projection into an engagement recess automatically after establishing the strain relief by the strain relief mechanism.

19. A plug as claimed in claim 16, wherein the engagement recesses are formed between walls extending radially outward relative to the axial bore.

20. A plug as claimed in claim 16, wherein the engagement recesses are arranged equidistantly in the circumferential direction of the plug sleeve.

21. A plug as claimed in claim 20, wherein the plug sleeve has an end section at least partially provided with an external thread, the plug cap having an internal thread section being screwable onto the end section.

22. A plug as claimed in claim 21, further comprising a sealing seat for accommodating a sealing element for sealing the cable, the sealing seat being connected to the external thread as a free end of the end section of the plug sleeve.

23. A plug as claimed in claim 22, wherein the opening rim comprises a sealing lip projecting in the direction toward the abutment end of the sealing element.

24. A plug as claimed in claim 23, wherein the sealing lip is formed as a V-notch encompassing the axial bore within the plug sleeve.

25. A plug as claimed in claim 23, wherein the sealing element comprises a sealing rim engaging into a recess between the sealing lip and the lamellae.

26. A plug as claimed in claim 23, wherein the sealing element is formed at least of two parts formed by an outer sealing ring and an inner sealing ring.

27. A plug as claimed in claim 26, wherein the outer sealing ring and the inner sealing ring are made of different materials.

28. A plug as claimed in claim 26, wherein the inner sealing ring comprises an annularly extending sealing flange as a sealing rim.

29. A plug as claimed in claim 28, wherein the outer sealing ring can be slipped onto the inner sealing ring for abutment with the sealing flange arranged on the one end of the inner sealing ring.

30. A plug as claimed in claim 21, wherein the engagement recesses are arranged adjoining the end section.

31. A plug as claimed in claim 30, wherein the plug cap has an annular flange at least accommodating the engagement recesses adjoining the internal thread section.

32. A plug as claimed in claim 31, wherein the internal thread section is formed adjacent to the annular flange as a screw aid having a hexagonal outer contour.

33. A plug as claimed in claim 31, wherein an insertion opening is arranged in the annular flange through which a rotation prevention projection can be brought into engagement with an engagement recess.

34. A plug as claimed in claim 33, wherein the rotation prevention projection projects in an arm-like manner from a clamping element and with its free arm end engages through the insertion opening into an engagement recess at clamping elements fixed to one another.

35. A plug as claimed in claim 34, wherein the rotation prevention arm is resiliently deflectable.

36. A plug as claimed in claim 34, wherein the rotation prevention arm extends in a first arm section adjacent to the clamping element transversely toward the outside relative to the plug cap and by an adjoining second arm section transversely downwards in the direction towards the axial bore, and an obtuse angle is formed between the arm sections.

37. A plug as claimed in claim 36, wherein the internal thread section has on its outer side a ramp recess extending substantially in the direction toward the first arm section.

38. A plug as claimed in claim 31, wherein an outer diameter of the annular flange is larger than an outer diameter of the internal thread section.

39. A plug as claimed in claim 38, wherein the sealing seat is formed at least by an opening rim of the axial bore in the end section at which the substantially annular sealing element abuts with its abutment end.

40. A plug as claimed in claim 39, wherein an annular chamber of variable diameter for accommodating the sealing element projects from the opening rim in the direction towards the plug cap.

41. A plug as claimed in claim 40, wherein a screwing-on taper is formed within the plug cap, the tapes contacting the annular chamber for reducing the diameter thereof when screwing the plug cap onto the plug sleeve.

42. A plug as claimed in claim 40, wherein the annular chamber comprises a wall of resiliently deflectable lamellae projecting from the opening rim substantially in the axial direction.

43. A plug as claimed in claim 42, wherein the lamellae extend from the opening rim in an inclined manner toward the inside.

* * * * *